US008385806B2

(12) United States Patent
Morikawa

(10) Patent No.: US 8,385,806 B2
(45) Date of Patent: Feb. 26, 2013

(54) IMAGE FORMING APPARATUS CAPABLE OF IMPARTING GLOSS TO A DESIRED PORTION OF A RECORDING SHEET

(75) Inventor: Daisuke Morikawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 12/896,657

(22) Filed: Oct. 1, 2010

(65) Prior Publication Data

US 2011/0103855 A1 May 5, 2011

(30) Foreign Application Priority Data

Nov. 4, 2009 (JP) ..... 2009-253072

(51) Int. Cl.
*G03G 15/20* (2006.01)

(52) U.S. Cl. ..... 399/341

(58) Field of Classification Search ..... 399/67, 399/341

See application file for complete search history.

(56) References Cited

U.S. PATENT DOCUMENTS 7,324,779 B2 * 1/2008 Anderson et al. ..... 399/341
7,672,634 B2 * 3/2010 Lofthus et al. ..... 399/341

FOREIGN PATENT DOCUMENTS

JP 63-192068 A 8/1988
JP 2007-52175 A 3/2007

* cited by examiner

*Primary Examiner* — William J Royer
(74) *Attorney, Agent, or Firm* — Canon U.S.A., Inc. IP Division

(57) ABSTRACT

An image forming apparatus includes a sheet feeding unit configured to feed a recording sheet, a transfer unit configured to transfer a toner image to the recording sheet fed by the sheet feeding unit, a fixing unit configured to heat the toner image transferred to the recording sheet by the transfer unit, a gloss imparting unit configured to impart gloss to an arbitrary region of the recording sheet heated by the fixing unit, a calculation unit configured to calculate a shrinkage ratio of the recording sheet shrunk through heating by the fixing unit, and a correction unit configured to correct the region to which gloss is imparted by the gloss imparting unit according to the shrinkage ratio calculated by the calculation unit.

7 Claims, 8 Drawing Sheets

IMAGE FORMING APPARATUS CAPABLE OF IMPARTING GLOSS TO A DESIRED PORTION OF A RECORDING SHEET

BACKGROUND OF THE INVENTION

1. Field of the Invention

The present invention relates to an image forming apparatus, in particular, to an image forming apparatus imparting gloss to an image formed on a recording sheet.

2. Description of the Related Art

As a conventional image forming apparatus, there has been proposed, for example, a system in which a second fixing device is provided on the output side of a first fixing device and in which a recording sheet having passed through the first fixing device is re-heated by the second fixing device, thereby imparting gloss to the recording sheet (See, for example, Japanese Patent Application Laid-Open No. 63-192068).

In this system, it is possible to impart gloss to the entire surface of the recording sheet. However, it is impossible to exclusively impart gloss to a limited region of the recording sheet. Further, since heat is also applied to a region requiring no gloss, such a problem as an increase in power consumption is involved.

In view of this, there is adopted a system in which a thermal head serving as a second fixing device is used on the output side of a first fixing device to re-heat an arbitrary region, whereby gloss is imparted exclusively to a region where an image is formed (See, for example, Japanese Patent Application Laid-Open No. 2007-52175, paragraph [0080]).

However, in the system discussed in Japanese Patent Application Laid-Open No. 2007-52175, before gloss has been imparted to an arbitrary region of the recording sheet by re-heating the same by using the thermal head, the water that has been contained in the recording sheet is evaporated through the heating by the first fixing device. As a result of the evaporation of the water, the recording sheet shrinks after the fixing, resulting in a change in the size thereof.

The shrinkage ratio varies according to the kind and thickness of the recording sheet. In the case of an ordinary paper sheet, the lengths thereof in the longitudinal direction and the width direction both shrink approximately 0.1 to 0.5%. For example, in the case of an A3 size ordinary paper sheet, whose size is 297 mm×420 mm, assuming that its shrinkage ratio is maximum, i.e., 0.5%, it shrinks approximately 1.5 mm in the width direction and 2.1 mm in the longitudinal direction. In the case of a resolution of 600 dpi, shrinkage, for example, by 2.1 mm corresponds to a shrinkage amount of approximately 4 pixels.

As a result, if, at the time of re-heating by the thermal head, the pattern of power supplied to each resistor of the thermal head is determined based on the image data before the fixing, the region to which gloss is to be imparted is deviated by an amount corresponding to the shrinkage of the recording sheet. And, there arises unevenness in gloss at, for example, character edge portions and image region ends.

SUMMARY OF THE INVENTION

The present invention is directed to an image forming apparatus capable of imparting gloss to a desired portion of a recording sheet even if the recording sheet has shrunk after fixing.

An image forming apparatus includes a sheet feeding unit configured to feed a recording sheet, a transfer unit configured to transfer a toner image to the recording sheet fed by the sheet feeding unit, a fixing unit configured to heat the toner image transferred to the recording sheet by the transfer unit, a gloss imparting unit configured to impart gloss to an arbitrary region of the recording sheet heated by the fixing unit, a calculation unit configured to calculate a shrinkage ratio of the recording sheet shrunk through heating by the fixing unit, and a correction unit configured to correct the region to which gloss is imparted by the gloss imparting unit according to the shrinkage ratio calculated by the calculation unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
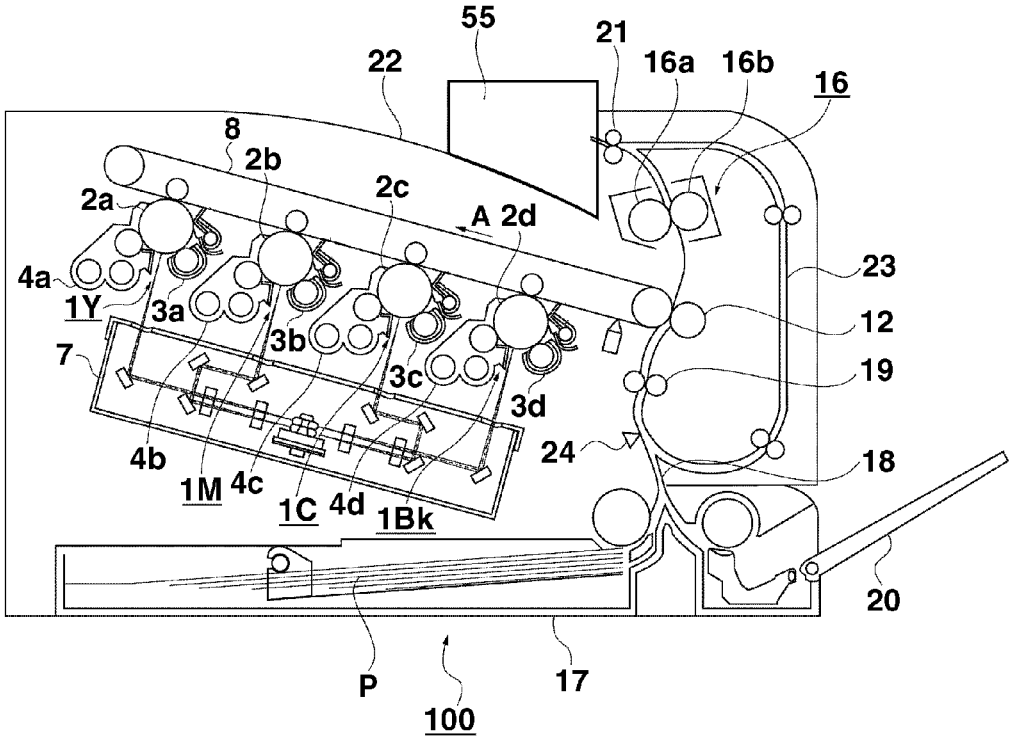
FIG. 1 is a sectional view of an image forming apparatus.

FIG. 1 is a sectional view of an image forming apparatus 100. The image forming apparatus 100 is equipped with four image forming units: an image forming unit 1Y forming a yellow image, an image forming unit 1M forming a magenta image, an image forming unit 1C forming a cyan image, and an image forming unit 1Bk forming a black image.

A laser scanner unit 7 is arranged below an intermediate transferring belt 8, and irradiates photosensitive members of the different colors: a photosensitive member 2*a* (yellow), a photosensitive member 2*b* (magenta), a photosensitive member 2*c* (cyan), and a photosensitive member 2*d* (black) with a laser beam modulated based on image data of the different colors. Before the irradiation with the laser beam, the entire surfaces of the photosensitive members 2*a*, 2*b*, 2*c*, and 2*d* are charged respectively by primary chargers 3*a* (yellow), 3*b* (magenta), 3*c* (cyan), and 3*d* (black).

Developing devices 4*a*, 4*b*, 4*c*, and 4*d* cause toners of the different colors to electrostatically adhere to the photosensitive members 2*a*, 2*b*, 2*c*, and 2*d*of the different colors irradiated with the laser beam by the laser scanner unit 7. The toners adhering to the photosensitive members 2*a*, 2*b*,2*c*, and 2*d* of the different colors are transferred to the intermediate transferring belt 8. The intermediate transferring belt 8 runs in the direction of the arrow A in the drawing, and the transferred toner images of the different colors are transferred to a recording sheet P by a secondary transfer roller 12.

Further below, there are arranged a sheet feeding unit 17 and a manual feed multi-tray 20. A conveyance path 18 for the recording sheet P, conveyance rollers 19, and the secondary transfer roller 12 are arranged vertically, and a fixing device 16 is provided above them.

The fixing device 16 consists of a fixing film 16*a* containing a heat source such as a ceramic substrate with a heater pattern printed thereon, and a pressurization roller 16*b* pressurized against the ceramic substrate with the fixing film 16*a* therebetween.

Further, on the downstream side of the fixing device 16, there are arranged fixing discharge rollers 21 and a gloss imparting device 55. In a case where images are to be formed on the front and back surfaces of the recording sheet P, the fixing discharge rollers 21 are caused to make reverse rotation, whereby the recording sheet P, whose one side has undergone image formation and fixing, is conveyed to a duplex conveyance path 23, and is fed in the direction of the secondary transfer roller 12 to perform image formation on the back surface of the recording sheet P.

A line sensor 24 is provided in such a manner that the longitudinal direction thereof corresponds to the width direction that is orthogonal to the conveyance direction of the recording sheet P. It is used to detect the length in the width direction of the recording sheet P prior to the passing of the fixing device 16. As will be described in detail below, the length in the width direction of the recording sheet P prior to the fixing as detected here is used for the calculation of the shrinkage ratio of the recording sheet P after the passing of the fixing device 16.

The gloss imparting device 55 is a device adapted to re-heat an arbitrary region of the recording sheet P to impart gloss thereto. After the completion of the imparting of gloss to the recording sheet P by the gloss imparting device 55, the recording sheet P is discharged onto a discharge tray 22 from the gloss imparting device 55.

Figure 2:
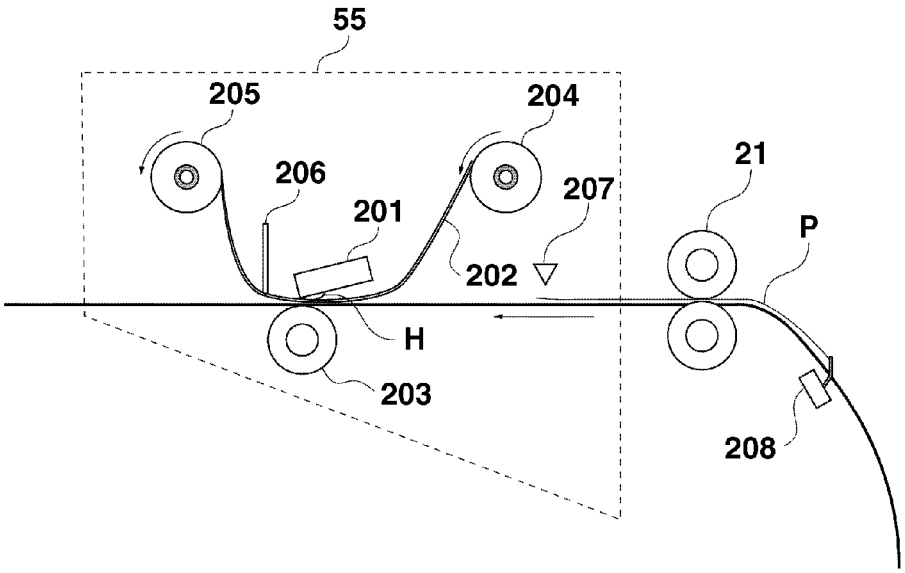
FIG. 2 is a sectional view of a gloss imparting device.

FIG. 2 is a sectional view of the gloss imparting device 55. The fixing discharge rollers 21 are positioned on the downstream side of the fixing device 16, and convey the recording sheet P discharged from the fixing device 16 to the gloss imparting device 55. A fixing delivery sensor 208 is arranged between the fixing device 16 and the fixing discharge rollers 21. It detects the leading edge and the trailing edge of the recording sheet P discharged from the fixing device 16, and monitors to make sure that no recording sheet P is staying in the fixing device 16.

Figure 3:
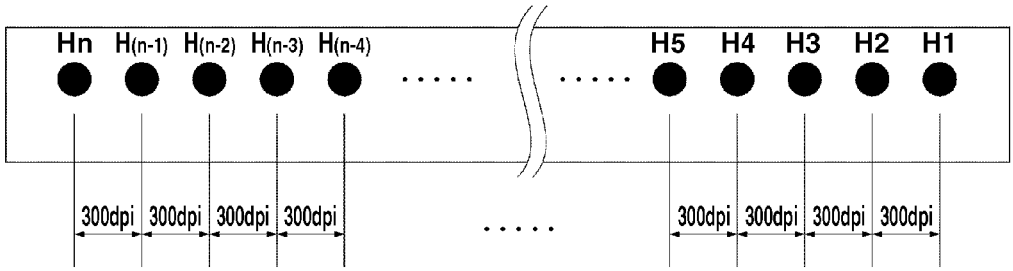
FIG. 3 is a diagram illustrating the head arrangement of a thermal head.

The gloss imparting device 55 is equipped with a thermal head 201. As illustrated in FIG. 3, n heat generating portions (H1, H2, . . . , Hn) are provided at the forward end H of the thermal head 201. Approximately 5000 heat generating portions (H1, H2, . . . , Hn) are arranged at intervals of 300 dpi in a length corresponding to the width of the recording sheet P.

A film 202 of a limited length is sent out from a send-out roller 204, and is taken up by a take-up roller 205. An opposing roller 203 opposed to the thermal head 201 conveys the recording sheet P. A separation plate 206 serves to separate the film 202 and the recording sheet P from each other.

A line sensor 207 is provided in such a manner that the longitudinal direction thereof corresponds to the width direction that is orthogonal to the conveyance direction of the recording sheet P. It is arranged between the fixing discharge rollers 21 and the opposing roller 203. Due to the line sensor 207, it is possible to measure the length in the width direction, which is orthogonal to the conveyance direction, of the recording sheet P after the fixing. Further, the line sensor 207 is also used to detect the positional deviation amount in the width direction of the recording sheet P, so that it is possible to perform re-heating by the thermal head 201 at an accurate position on the recording sheet P.

The recording sheet P conveyed in the direction of the arrow by the fixing discharge rollers 21 passes a nip portion formed by the film 202 and the opposing roller 203. At this time, only the regions of the toner image on the recording sheet P corresponding to the regions of the thermal head 201 turned on are re-heated, thereby forming an image with gloss imparted thereto.

The re-heated recording sheet P is sent out to the left together with the film 202. The recording sheet P is separated from the film 202 by the separation plate 206, and the film 202 is taken up by the take-up roller 205, whereas solely the recording sheet P is discharged from the gloss imparting device 55.

Figure 4:
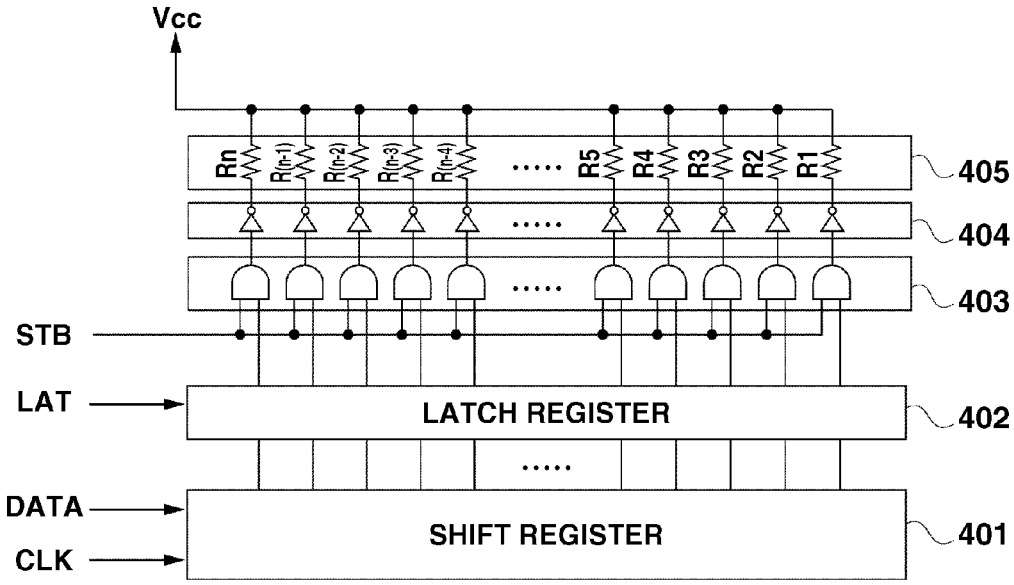
FIG. 4 is a block diagram illustrating an electrical construction of the thermal head.

FIG. 4 is a block diagram illustrating an electrical construction of the thermal head 201. A shift register 401 stores DATA signals successively input from a central processing unit (CPU) 502 described below in synchronization with clock (CLK) signals by an amount corresponding to one line. A latch register 402 latches the data of the shift register 401 with the timing of a latch (LAT) signal. Here, the latched data constitutes a drive signal for driving the thermal head 201.

When a STB signal is High, a gate circuit 403 outputs the drive signal latched by the latch register 402. A driver device 404 is a device for driving the thermal head 201. When a High signal is input to the device, the thermal head 201 is turned on. A resistor heater 405 is formed by n resistors (R1, R2, . . . , Rn) provided corresponding to the n heat generating portions (H1, H2, . . . , Hn) of the thermal head 201.

Figure 5:
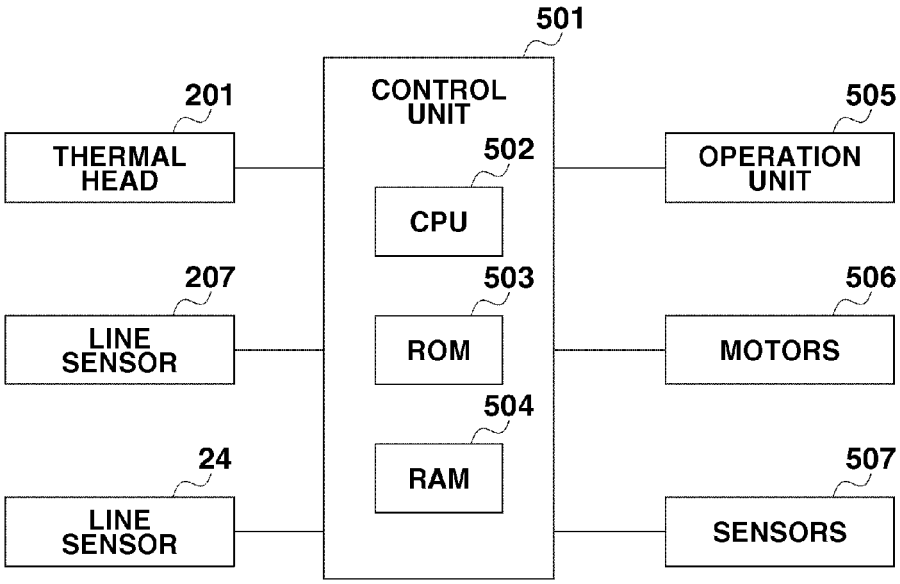
FIG. 5 is a block diagram illustrating a control system for the image forming apparatus and the gloss imparting device.

FIG. 5 is a control block diagram for the image forming apparatus 100 and the gloss imparting device 55. A control unit 501 includes a CPU 502, a read-only memory (ROM) 503, and a random-access memory (RAM) 504. The CPU 502 is a control circuit controlling the entire image forming apparatus 100. The ROM 503 stores a control program for controlling various processing operations executed by the image forming apparatus 100. The RAM is a system work memory for the operation of the CPU 502. It also functions as image memory for temporarily storing image data.

The CPU 502 receives image data from an external scanner, a personal computer (PC), a facsimile apparatus (FAX), and the like, and controls various motors 506 according to the output of various sensors 507 provided inside the image forming apparatus 100, to perform an image forming operation on the recording sheet P. Further, by using an input key on an operation unit 505, the user can give the CPU 502 an instruction to change the display on a display unit provided on the operation unit 505.

As described above, the thermal head 201 and the line sensor 207 are provided in the gloss imparting device 55. The line sensor 207 includes a contact image sensor (CIS), a charge-coupled device (CCD) line sensor or the like, and a light source, i.e., a light emitting portion (not illustrated), and a light receiving portion receiving reflected scattered light and converting it to image data. A line sensor 24 provided in the image forming apparatus 100 has a construction similar to that of the line sensor 207.

Figure 6:
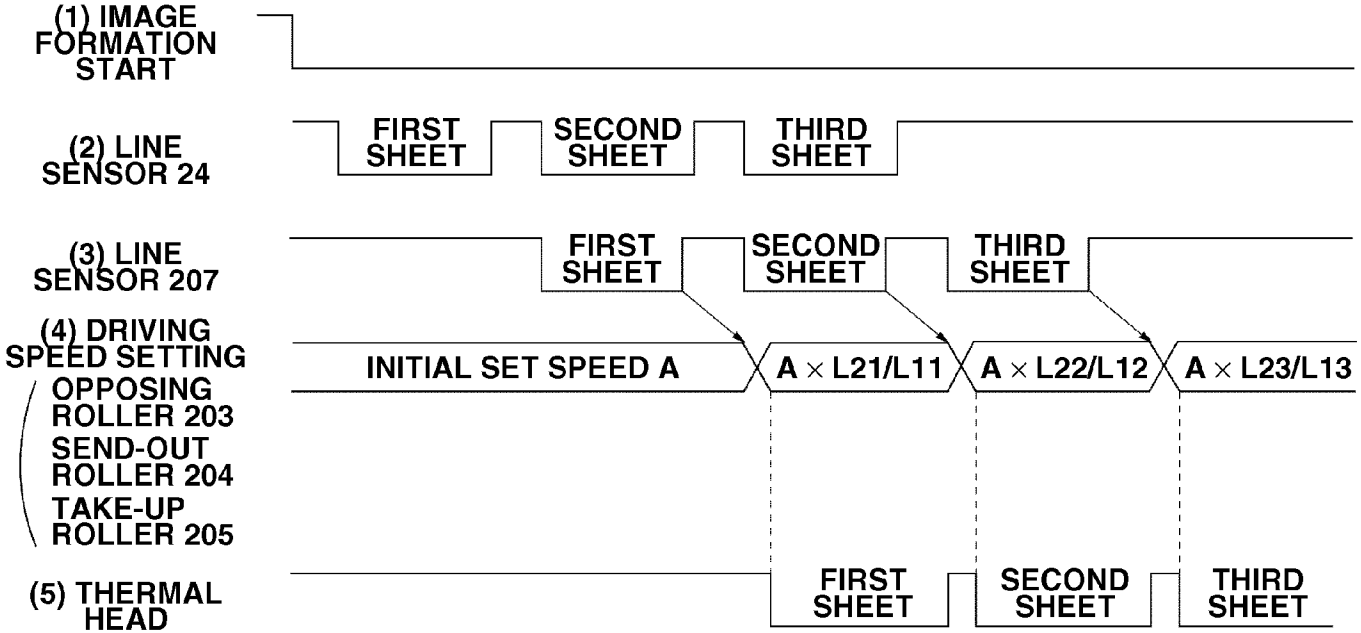
FIG. 6 is a timing chart illustrating an operational timing when a gloss imparting operation is performed.

FIG. 6 is a timing chart illustrating the operational timing when the gloss imparting operation is performed. The following items (1) through (5) illustrate the steps of the gloss imparting operation.

(1) First, upon receiving image data from the external scanner, PC, FAX, and the like, the CPU 502 starts the operation of forming an image on the recording sheet P.

(2) A predetermined number of (e.g., three) recording sheets P on which image formation is to be performed are fed from the sheet feeding unit 17 or the manual feed multi-tray 20. And, based on the detection result of the line sensor 24 serving as a first detection unit, the lengths in the width direction of the recording sheets P before passing through the fixing device 16 (first lengths) are detected. Here, the lengths in the width direction of the recording sheets P before the fixing will be respectively referred to as L11 (first sheet), L12 (second sheet), and L13 (third sheet).

(3) The recording sheets P that have undergone image formation and fixing are conveyed to the gloss imparting device 55. And, based on the detection result of the line sensor 207 serving as a second detection unit, the lengths in the width direction of the recording sheets P after the passing of the fixing device 16 (second lengths) are measured. Here, the lengths in the width direction of the recording sheets P after the fixing will be respectively referred to as L21 (first sheet), L22 (second sheet), and L23 (third sheet). The CPU 502 calculates the shrinkage ratios of the recording sheets P based on the lengths in the width direction of the recording sheets P before the fixing as measured in step (2) and the lengths in the width direction of the recording sheets P after the fixing as measured in step (3). More specifically, the shrinkage ratio of the first recording sheet P is L21/L11, the shrinkage ratio of the second recording sheet P is L22/L12, and the shrinkage ratio of the third recording sheet P is L23/L13.

(4) As described above, as the recording sheets P shrink, there is generated a positional deviation corresponding to several pixels, so that, to accurately impart gloss, it is necessary to adjust the conveyance speed of the recording sheets P. In view of this, the driving speed at which the send-out roller 204, the take-up roller 205, and the opposing roller 203 are rotated is varied. Assuming that the initial set speed is A mm/s, the driving speed of the rollers 203 through 205 when conveying the recording sheets P is corrected as follows: A1 =A×L21/L11 (first sheet); A2=A×L22/L12 (second sheet); and A3=A×L23/L1 (third sheet). That is, correction is performed in such a manner that the driving speed of each roller is reduced by an amount corresponding to the shrinkage of the recording sheets P. Through this correction, even in a case where the recording sheets P have shrunk as a result of passing the fixing device 16, it is possible to accurately impart gloss in the conveyance direction of the recording sheets P.

(5) Regarding the shrinkage in the width direction of the recording sheets P, it is dealt with through correction of the regions heated by the thermal head 201. More specifically, the region to be heated by the thermal head 201 is corrected based on the shrinkage ratio of the recording sheet P calculated by the CPU 502 and the edge positions of the recording sheet P detected by the line sensor 207. This will be described with reference to FIG. 7.

Figure 7:
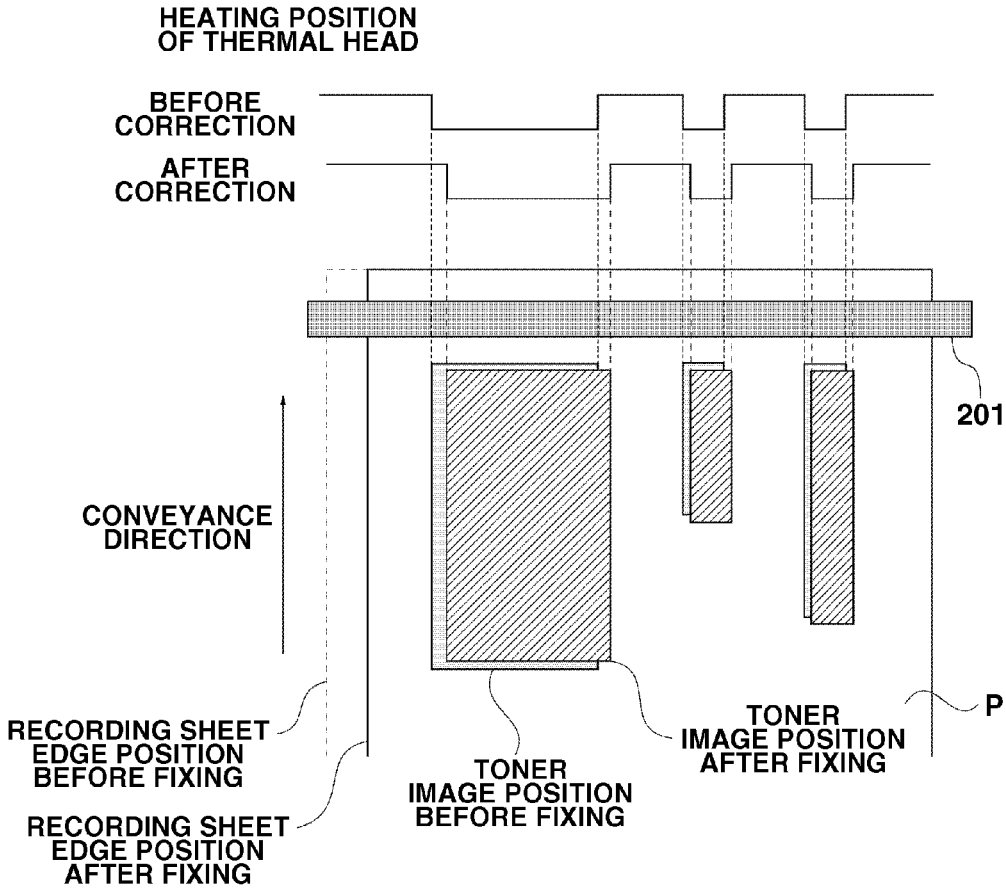
FIG. 7 illustrates heating region correction for the thermal head.

In FIG. 7, the position of the toner image before fixing is indicated by a dot-shaded portion, and the position of the toner image after fixing is indicated by a line-shaded portion. Further, using the right-hand end as a reference, the end position of the recording sheet P before fixing is indicated by a dashed line, and the end position of the recording sheet P after fixing is indicated by a solid line.

The heating position of the thermal head 201 before correction corresponds to the heating pattern of the thermal head 201 generated based on the image data when image formation is performed on the recording sheet P. The heating position of the thermal head 201 after correction is obtained by performing heating-position correction on the heating pattern of the thermal head 201 before correction based on the shrinkage ratio of the recording sheet P and the edge positions of the recording sheet P detected by the line sensor 207.

That is, the position of the heating pattern is shifted in the width direction based on the edge positions of the recording sheet P detected by the line sensor 207, and correction is performed so as to reduce the heating position in the heating pattern based on the shrinkage ratio of the recording sheet P. The CPU 502 causes the heating pattern of the thermal head 201 after the correction to be reflected in the DATA signal input to the shift register 401 of FIG. 4, thereby realizing the above-mentioned correction.

Figure 8:
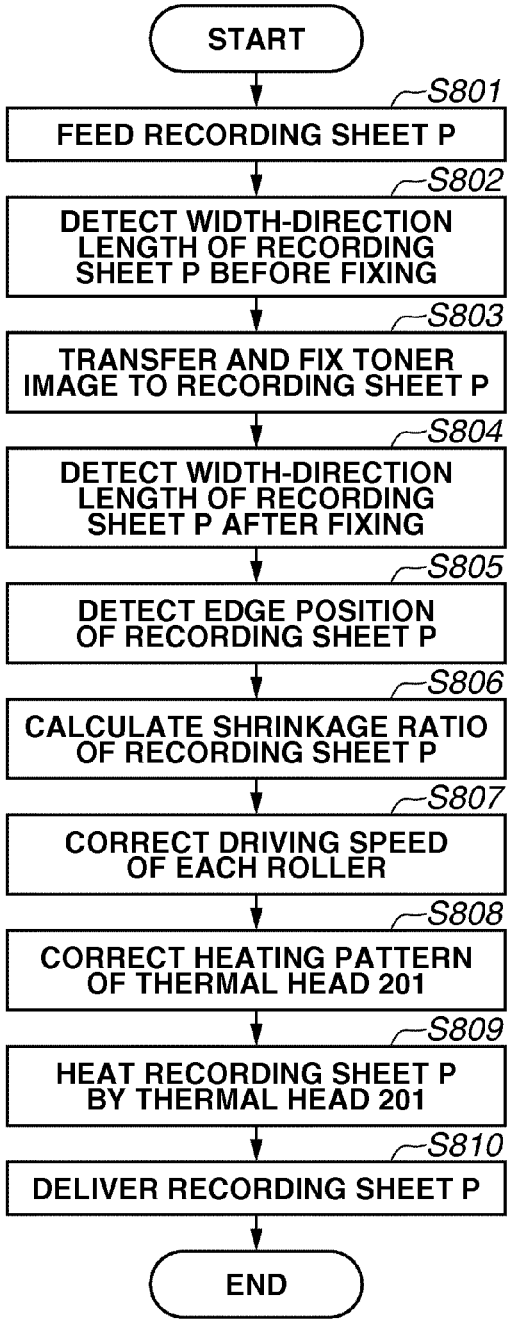
FIG. 8 is a flowchart illustrating the gloss imparting operation.

FIG. 8 is a flowchart illustrating the gloss imparting operation. The program for executing this flowchart is stored in the ROM 503, and is executed by being read by the CPU 502.

First, upon receiving image data from the external scanner, PC, FAX, and the like, in step S801, the CPU 502 starts the feeding of the recording sheet P. And, in step S802 based on the output of the line sensor 24, the CPU 502 detects the length in the width direction of the recording sheet P before fixing. Next, in step S803, the CPU 502 performs the transfer of a toner image from the intermediate transferring belt 8 to the recording sheet P and the fixing of the toner image on the recording sheet P by the fixing device 16.

When the recording sheet P having passed the fixing device 16 reaches the gloss imparting device 55, in step S804, the CPU 502 detects the length in the width direction of the recording sheet P after the fixing based on the output of the line sensor 207, and, in step S805, detects the edge positions of the recording sheet P. And, as described above, in step S806, the CPU 502 calculates the shrinkage ratio of the recording sheet P based on the length in the width direction of the recording sheet P before and after the fixing.

Next, in step S807, as described above, according to the shrinkage ratio calculated, the CPU 502 corrects the driving speed of the opposing roller 203, of the send-out roller 204, and of the take-up roller 205. Through this correction, it is possible to correct the deviation of the heating position of the thermal head 201 due to the shrinkage of the recording sheet P in the conveyance direction.

After this, as described above, in step S808, the CPU 502 corrects the heating pattern of the thermal head 201 according to the shrinkage ratio of the recording sheet P and the edge positions of the recording sheet P detected by the line sensor 207. Through this correction, it is possible to correct the deviation of the heating position of the thermal head 201 due to the shrinkage in the width direction of the recording sheet P.

And, in step S809, the CPU 502 heats the recording sheet P by the thermal head 201 based on the corrected heating pattern, and, in step S810, delivers the recording sheet P onto the discharge tray 22.

By performing the above-described control, it is possible to impart gloss to a desired position even in the case of a recording sheet P that has shrunk as a result of passing the fixing device 16.

In the first exemplary embodiment, solely the shrinkage ratio in the width direction of the recording sheet P is calculated, and the heating pattern of the thermal head 201 and the driving speed of the rollers 203 through 205 are corrected. In a second exemplary embodiment, the shrinkage ratio in the width direction of the recording sheet P is calculated to correct the heating pattern of the thermal head 201, and the shrinkage ratio in the conveyance direction of the recording sheet P is calculated to correct the driving speed of the rollers 203 through 205. In the following, a description of the features that are similar to those of the first exemplary embodiment will be omitted.

In the present exemplary embodiment, when image formation is started in step (1) of FIG. 6, there is measured, in step (2), a passage time T11 (first passage time) between when the CPU 502 detects the leading edge of the recording sheet P using the line sensor 24 and when the CPU 502 detects the trailing edge of the recording sheet P using the line sensor 24. Further, in step (3), there is measured a passage time T21 (second passage time) between when the CPU 502 detects the leading edge of the recording sheet P using the line sensor 207 and when the CPU 502 detects the trailing edge of the recording sheet P using the line sensor 207.

In the present exemplary embodiment, it is a prerequisite that the distance from the line sensor 207 to the thermal head 201 is longer than the length in the conveyance direction of the recording sheet P.

The shrinkage ratio in the conveyance direction of the recording sheet P is obtained from the ratio of these times, T21/T11. Similarly, the shrinkage ratio of the second sheet is obtained as T22/T12, and the shrinkage ratio of the third sheet is obtained as T23/T13.

In step (4), assuming that the initial set speed of the rollers 203 through 205 is A mm/s, the driving speed A1 after the correction of the rollers 203 through 205 is corrected so as to be A1=A×T21/T11. Similarly, the driving speed for the second sheet is corrected so as to be A2=A×T22/T12, and the driving speed for the third sheet is corrected so as to be A3=A×T23/T13. As for step (5), it is similar to that in the first exemplary embodiment.

By performing the control described above, both the shrinkage ratios in the width direction and in the conveyance direction of the recording sheet P are calculated, so that it is possible to more accurately correct the position to which gloss is to be imparted.

While, in the above exemplary embodiment, the time between when the leading edge of the recording sheet P after fixing is detected by using the line sensor 207 and when the trailing edge thereof is detected, is detected, it is also possible to use a fixing delivery sensor 208 instead of the line sensor 207.

Further, regarding the correction of the region to which gloss is to be imparted in the conveyance direction of the recording sheet P, instead of correcting the driving speeds of the rollers 203 through 205, it is possible to obtain a similar effect by correcting the driving time per line of the thermal head 201. That is, a similar effect can be obtained by shortening the driving time per line of the thermal head 201 based on the shrinkage ratio in the conveyance direction of the recording sheet P.

Further, while, in the above-described example, a thermal head 201 is used as the gloss imparting unit, gloss may be imparted to a part of the recording sheet P by forming a transparent toner image in the region to which gloss is to be imparted. In this case, the region where the transparent toner image is formed is corrected by the CPU 502 based on the shrinkage ratio of the recording sheet P.

Further, while, in the above exemplary embodiment, a tandem type color image forming apparatus is used as the image forming apparatus 100, it is not limited thereto. The present invention is applicable to any type of image forming apparatus so long as it employs electrophotography.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-253072 filed Nov. 4, 2009, which is hereby incorporated by reference herein in its entirety.

What is claimed is:

1. An image forming apparatus comprising:

a sheet feeding unit configured to feed a recording sheet;

a transfer unit configured to transfer a toner image to the recording sheet fed by the sheet feeding unit;

a fixing unit configured to heat the toner image transferred to the recording sheet by the transfer unit;

a gloss imparting unit configured to impart gloss to an arbitrary region of the recording sheet heated by the fixing unit;

a calculation unit configured to calculate a shrinkage ratio of the recording sheet shrunk through heating by the fixing unit; and a correction unit configured to correct the region to which gloss is imparted by the gloss imparting unit according to the shrinkage ratio calculated by the calculation unit.

2. The image forming apparatus according to claim 1, wherein the gloss imparting unit is a thermal head arranged such that its longitudinal direction is orthogonal to a conveyance direction of the recording sheet, and wherein the correction unit corrects a heating pattern of the thermal head according to the shrinkage ratio calculated by the calculation unit.

3. The image forming apparatus according to claim 1, further comprising:

a conveyance unit configured to convey the recording sheet heated by the fixing unit and to cause the recording sheet to pass the gloss imparting unit, wherein the correction unit corrects a conveyance speed of the conveyance unit according to the shrinkage ratio calculated by the calculation unit.

4. The image forming apparatus according to claim 1, further comprising:

a first detection unit configured to detect a first length that is a length of the recording sheet in a width direction orthogonal to a conveyance direction of the recording sheet before the recording sheet is heated by the fixing unit; and a second detection unit configured to detect a second length that is the length of the recording sheet in the width direction after the recording sheet is heated by the fixing unit, wherein the calculation unit calculates the shrinkage ratio in the width direction based on a ratio of the first length detected by the first detection unit to the second length detected by the second detection unit.

5. The image forming apparatus according to claim 4, wherein the first detection unit detects a first passage time of the recording sheet from a leading edge to a trailing edge before the recording sheet is heated by the fixing unit, wherein the second detection unit detects a second passage time of the recording sheet from the leading edge to the trailing edge after the recording sheet is heated by the fixing unit, and wherein the calculation unit calculates the shrinkage ratio in the conveyance direction based on the ratio of the first passage time detected by the first detection unit to the second passage time detected by the second detection unit.

6. The image forming apparatus according to claim 5, wherein the second detection unit detects a position of the recording sheet in the width direction, and wherein the correction unit corrects the region to which gloss is to be imparted by the gloss imparting unit according to the shrinkage ratio calculated by the calculation unit and edge positions of the recording sheet detected by the second detection unit.

7. The image forming apparatus according to claim 1, wherein the gloss imparting unit is configured to form a transparent toner image in an arbitrary region of the recording sheet, and wherein the correction unit corrects the region where the transparent toner image is formed according to the shrinkage ratio calculated by the calculation unit.

* * * * *